US005770341A

United States Patent [19]

Mukudai et al.

[11] Patent Number: 5,770,341

[45] Date of Patent: Jun. 23, 1998

[54] FRICTION CHARGE-PROVIDING MEMBER FOR POSITIVELY-CHARGEABLE TONER

[76] Inventors: Osamu Mukudai; Yuji Matsuura; Hiroyoshi Yamaga, all of c/o Hodogaya Chemical Co., Ltd., Tsukuba Laboratory, 45, Miyukigaoka, Tsukuba-shi, Ibaraki, Japan

[21] Appl. No.: 361,589

[22] Filed: Dec. 22, 1994

[30] Foreign Application Priority Data

Dec. 22, 1993 [JP] Japan ..... 5-345471

[51] Int. Cl.[6] ..... G03G 9/097

[52] U.S. Cl. ..... 430/110; 430/108

[58] Field of Search ..... 430/58, 72, 108, 430/110

[56] References Cited

U.S. PATENT DOCUMENTS

| | | | |
|---|---|---|---|
| 4,433,040 | 2/1984 | Niimura et al. | 430/110 |
| 4,985,328 | 1/1991 | Kumagai et al. | 430/110 |
| 5,034,300 | 7/1991 | Anno et al. | 430/108 |
| 5,240,803 | 8/1993 | Ota | 430/110 |
| 5,288,580 | 2/1994 | Julien et al. | 430/110 |
| 5,439,770 | 8/1995 | Taya et al. | 430/110 |

FOREIGN PATENT DOCUMENTS

| | | |
|---|---|---|
| 59-15259 | 1/1984 | Japan . |
| 61-006660 | 1/1986 | Japan . |
| 62-28769 | 2/1987 | Japan . |

OTHER PUBLICATIONS

Patent Abstract of Japan, vol. 10, No. 308 (P–508), Oct. 21, 1986, JP–A–61122660, Oct. 6, 1986.

Patent Abstracts of Japan, vol. 10, No. 308 (P–508), Oct. 21, 1986, JP–A–61122661, Oct. 6, 1986.

Patent Abstracts of Japan, vol. 10, No. 308 (P–508), Oct. 21, 1986, and Derwent Abstracts, AN–86–187860, JP–A–61122664, Jun. 10, 1986.

Patent Abstracts of Japan, vol. 9, No. 50 (P–339), Feb. 5, 1985, JP–A–59188660, Oct. 26, 1984.

Derwent Abstract of JP–A–59–15259.

Derwent Abstract of JP–A–61–006660.

Chemical Abstracts 107:87145.

*Primary Examiner*—Janet C. Baxter

[57] ABSTRACT

A friction charge-providing member for positively-chargeable toner is disclosed, which comprises a parent material having provided at least on the surface thereon a compound represented by formula (I) as a charge-controlling agent:

(I)

wherein A and A' may be the same or different and each independently represents a hydrogen atom, a halogen atom, a nitro group, an alkyl group having 1 to 18 carbon atoms which may contain a substituent(s), an alkenyl group, an acyl group, a sulfonic acid group, a sulfamoyl group, a N-substituted sulfamoyl group, an alkylsulfonyl group having 1 to 5 carbon atoms, a carboxyl group, an alkylester group having 1 to 5 carbon atoms, a hydroxyl group, an alkoxyl group having 1 to 18 carbon atoms, an amino group, and a N-substituted amino group; B and B' may be the same or different and each independently represents a hydrogen atom, a halogen atom, an alkyl group having 1 to 18 carbon atoms which may contain a substituent(s), an alkenyl group, an amino group, a N-substituted amino group, an acyl group, a benzoylamino group which may contain a substituent(s), a sulfamoyl group, an alkylester group having 1 to 5 carbon atoms, a hydroxyl group, an alkoxyl group having 1 to 18 carbon atoms and a N-substituted carbamoyl group; X, X' Y and Y' may be the same or different and each independently presents —O—, —COO—, —NH— and —S— and is present at ortho-position of an azo group; n, n', m and m' may be the same or different and each independently represents an integer of 1 to 4; Z represents a hydrogen atom, sodium, potassium, ammonium, aliphatic ammonium, alicyclic ammonium and heterocyclic ammonium; M represents chromium, cobalt and iron.

1 Claim, 1 Drawing Sheet

FRICTION CHARGE-PROVIDING MEMBER FOR POSITIVELY-CHARGEABLE TONER

FIELD OF THE INVENTION

The present invention relates to a carrier, conveyor members such as development sleeve and doctor blade and other friction charge-providing members for providing friction charge to a dry toner for use in the development of an electrostatic latent image in electrophotography, electrostatic recording, etc.

BACKGROUND OF THE INVENTION

In the electrophotographic image formation process, an electrostatic latent image is formed on an inorganic photoreceptor such as selenium, selenium alloy, cadmium sulfide and amorphous silicon or an organic photoreceptor comprising a charge-generating agent and a charge-transporting agent. The electrostatic latent image thus formed is developed with a toner, transferred to a paper or plastic film, and then fixed to obtain a visible image.

Photoreceptors can be charged positively or negatively depending on their configuration. The photoreceptors which allow a printed area to be left as an electrostatic latent image are developed with an oppositely-chargeable toner while those which allow a printed area to be destaticized to effect reversal development are developed with a toner chargeable to the same sign as the printed area.

In other words, if a negatively-chargeable photoreceptor is developed with an oppositely-chargeable toner and a positively-chargeable photoreceptor is subjected to reverse development, a positively-chargeable toner is used.

A toner comprises a binder resin, a colorant, and other additives. In order to have desirable friction chargeability (charging rate, charging level, charging stability, etc.), storage stability and environmental stability, the toner normally comprises a charge-controlling agent incorporated therein. Examples of the charge-controlling agent to be incorporated in the positively-chargeable toner include azinic dyes such as nigrosine, basic dyes such as triphenylmethane dyes, laked colors of basic dyes, metal complex dyes comprising quaternary ammonium residues incorporated in its skeletone, quaternary ammonium salts, laked compounds of quaternary ammonium salt, imidazole compounds, vinyl polymers containing an amino group(s), and condensed polymers containing an amino group(s).

However, dry toners have varieties such as one component or two component system and magnetic or nonmagnetic toners depending on the development process. Charge-controlling agents capable of providing satisfactory chargeability to these toners have been rarely found and put into practical use. Even charge-controlling agents which are possibly fit for practical use preferably appear somewhat on the surface of toner grains to fully exert its effects. This causes the charge-controlling agent to leave from the surface of the toner when the toner grains collide with each other or rub against the carrier or other members, contaminating the carrier or other members.

As a result, the chargeability of the toner is deteriorated, causing further deterioration thereof with the increase in the duplicated number of sheets. This results in troubles such as image density drop, reproducibility drop and fog formation.

Therefore, it has been proposed that the toner be provided with chargeability by means of a carrier, conveyor members such as development sleeve and doctor blade or other friction charge-providing members rather than by means of a charge-controlling agent or other additives. In this approach, there is no need to incorporate a charge-controlling agent or other additives in the toner. Thus, there causes no contamination on the carrier or other members, preventing chargeability drop that would result in the deterioration of image quality.

SUMMARY OF THE INVENTION

An object of the present invention is to provide a friction charge-providing member for positively-chargeable toner which can be coated on a carrier, conveyor members such as development sleeve and doctor blade or other friction charge-providing members, has a mechanically sufficient strength, can provide friction charge to these conveyor members or friction charge-providing members, exhibits no deterioration of properties even after prolonged use, and can provide a toner with an excellent positive-chargeability.

The foregoing object of the present invention will become more apparent from the following detailed description and examples.

As a result of extensive studies, the inventors have invented a friction charge-providing member for positively-chargeable toner which can be coated on a carrier, conveyor members such as development sleeve and doctor blade or other friction charge-providing members, has a mechanically sufficient strength, can provide friction charge to these conveyor members or friction charge-providing members, exhibits no deterioration of properties even after prolonged use, and can provide a toner with an excellent positive-chargeability.

The present invention relates to a friction charge-providing member for positively-chargeable toner, comprising a parent material having provided at least on the surface thereon a compound represented by formula (I) as a charge-controlling agent:

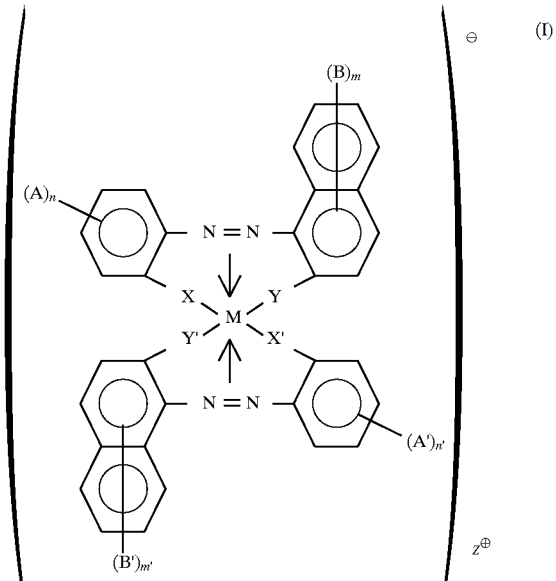

wherein A and A' may be the same or different and each independently represents a hydrogen atom, a halogen atom, a nitro group, an alkyl group having 1 to 18 carbon atoms which may contain a substituent(s), an alkenyl group, an acyl group, a sulfonic acid group, a sulfamoyl group, a N-substituted sulfamoyl group, an alkylsulfonyl group having 1 to 5 carbon atoms, a carboxyl group, an alkylester group having 1 to 5 carbon atoms, a hydroxyl group, an alkoxyl group having 1 to 18 carbon atoms, an amino group, and a N-substituted amino group; B and B' may be the same or different and each independently represents a hydrogen atom, a halogen atom, an alkyl group having 1 to 18 carbon atoms which may contain a substituent(s), an alkenyl group, an amino group, a N-substituted amino group, an acyl group, a benzoylamino group which may contain a substituent(s), a sulfamoyl group, an alkylester group having 1 to 5 carbon atoms, a hydroxyl group, an alkoxyl group having 1 to 18 carbon atoms and a N-substituted carbamoyl group; X, X' Y and Y' may be the same or different and each independently represents —O—, —COO—, —NH— and —S— and is present at ortho-position of an azo group; n, n', m and m' may be the same or different and each independently represents an integer of 1 to 4; Z represents a hydrogen atom, sodium, potassium, ammonium, aliphatic ammonium, alicyclic ammonium and heterocyclic ammonium; M represents chromium, cobalt and iron.

BRIEF DESCRIPTION OF THE DRAWING

By way of example and to make the description more clear, reference is made to the accompanying drawing in which.

DETAILED DESCRIPTION OF THE INVENTION

Figure 1:
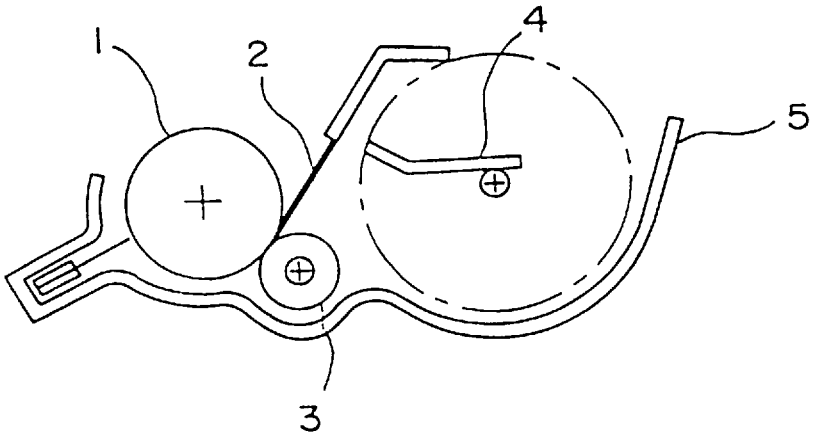
FIG. 1 is a sectional view of a typical example of a developing machine employing a friction charge-providing member according to the present invention wherein the reference number 1 shows a toner conveyor member, the reference number 2 shows an elastic blade, the reference number 3 shows a toner feed roller, the reference number 4 shows a toner agitator, and the reference number 5 shows a toner tank.

Examples of substituents for the alkyl group having 1 to 18 carbon atoms which may contain a substituent(s) and the benzoylamino group which may contain a substituent(s) described above include an OH group, a chlorine atom, a fluorine atom, an unsubstituted or substituted phenyl group, an alkoxyl group having 1 to 5 corbon atoms, an acetyl group, an amino group, an acetylamino group, an alkylamino gourp having 1 to 8 carbon atoms, a carboxyl group and a calbamoylphenyl group.

Examples of the aliphatic ammonium described above include mono-butyl ammonium, N-hexadecyl-N-methyl ammonium and tributyl ammonium.

Examples of the alicyclic ammonium described above include 1-dimethylpyrrolidinium, 1-dimethylpiperidinium and 1, 4-dimethylpiperidium.

Examples of the heterocyclic ammonium include 4-methyl morphonium, and 4-(2-chloroethyl) morphonium.

The preparation of the compound represented by the foregoing formula (I) to be incorporated, in the friction charge-providing member according to the present invention, at least on the surface thereof can be accomplished by any well known synthesis methods.

Compounds represented by formula (I) may be used singly or in combination. These compounds may be used in combination with other charge-controlling agents or other additives. These compounds may be directly used in the form of solution or dispersion in a solvent or may be used in the form of dispersion in a resin. Example of such a solvent include methanol, ethanol, buthanol, acetone, methylethylketone, tetrahydrofuran, toluene, xylene, and dimethylformamide. Examples of such a resin include silicone resin, fluorine resin, polyacrylic ester, polymethacrylic ester, polystyrene, polybutadiene, polyester, polyurethane, polyamide, epoxy resin, chlorinated paraffin, phenolic resin, polycarbonate, and copolymers thereof. These resins may be used singly or in admixture.

The coating solution obtained by dissolving or dispersing a charge-controlling agent represented by formula (I) may be coated on the parent material of a friction charge-providing member (e.g., a carrier, and conveyor members such as development sleeve and doctor blade) by dip coating process, spray coating process, brush coating process or the like, and then dried to obtain a friction charge-providing member for positively-chargeable toner according to the present invention. Alternatively, a resin comprising a compound represented by formula (I) dispersed therein may be formed into a friction charge-providing member such as doctor blade for positively-chargeable toner according to the present invention.

The coated amount of the charge-controlling agent is preferably from 0.1 to 100 mg per square meter of the parent material of a friction charge-providing member. The amount of the charge-controlling agent contained in the resin to be formed into a friction charge-providing member is preferably from 0.1 to 60% by weight.

As the parent material of carrier there can be used a particulate metal such as iron and aluminum, particulate alloy, particulate metallic compound such as particulate metal oxide, particulate glass, particulate ceramic or the like. Any wellknown carriers may be used. As the parent material of sleeve or doctor blade there can be used a metal, alloy or a nonmetallic substance such as plastic and rubber. Any sleeves or doctor blades which have heretofore been used can be used.

The carrier coated with the charge-controlling agent according to the present invention can be preferably used by being mixed with a toner so that the mixing ratio by weight of the carrier to the toner is from 2/98 to 10/90.

As the positively-chargeable toner to be used in combination with the charge-providing member according to the present invention there can be used one which has heretofore been used as an electrophotographic toner. In other words, such a positively-chargeable toner is a fine powder comprising carbon black or a colorant such as dye and pigment in a binder resin. The toner may contain a magnetic powder or no magnetic powder. Further, the toner may comprise an additive for improving the properties thereof, an external processing agent or the like incorporated therein. Moreover, the toner may contain a small amount (0.01 to 5% by weight) of a positively-chargeable charge-controlling agent.

Examples of the compound represented by formula (I) according to the present invention include the following compounds:

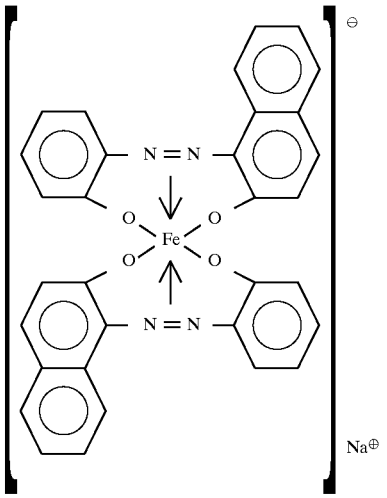
Compound No. (1)
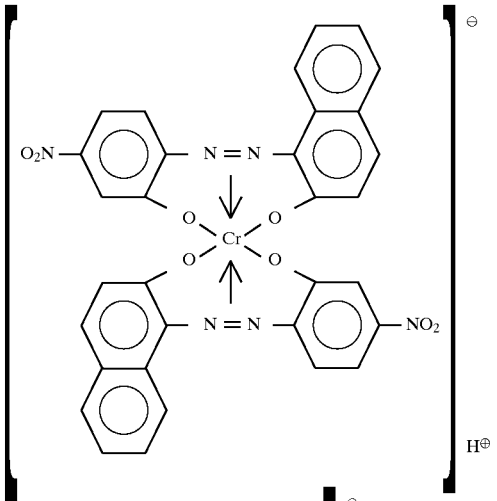
Compound No. (2)
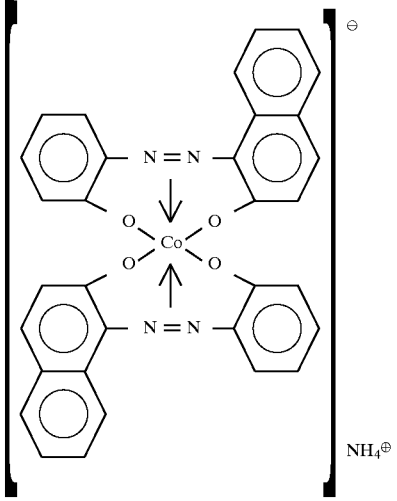
Compound No. (3)

-continued
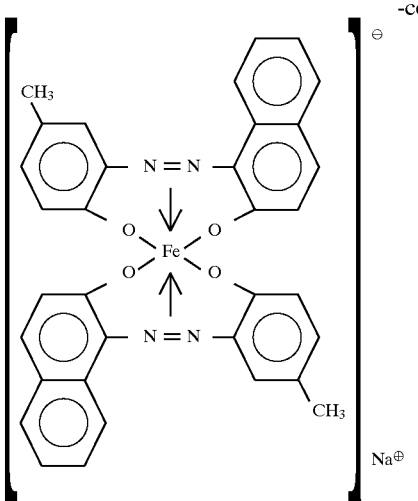
Compound No. (4)
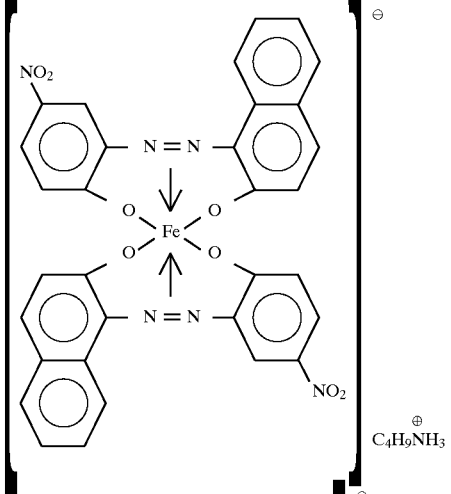
Compound No. (5)
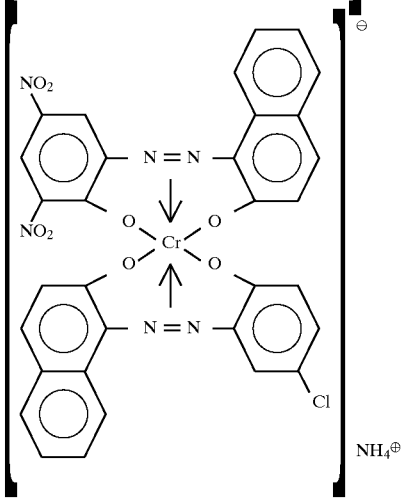
Compound No. (6)

-continued
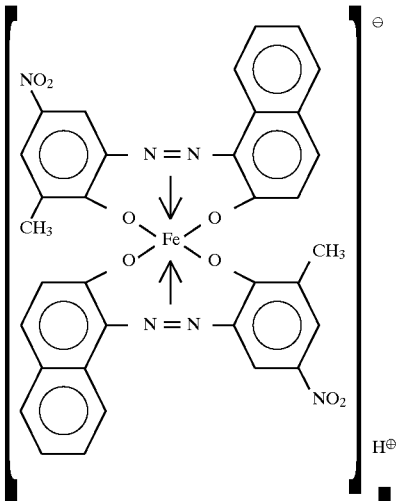
Compound No. (7)
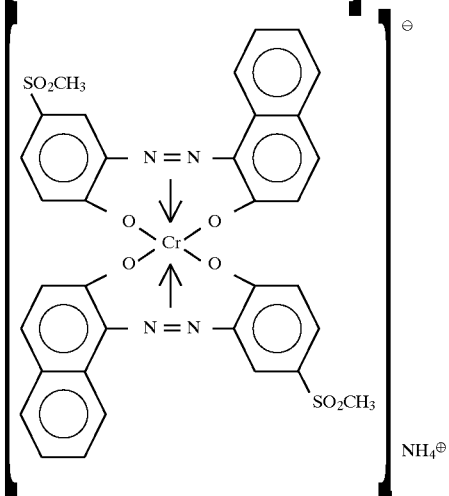
Compound No. (8)
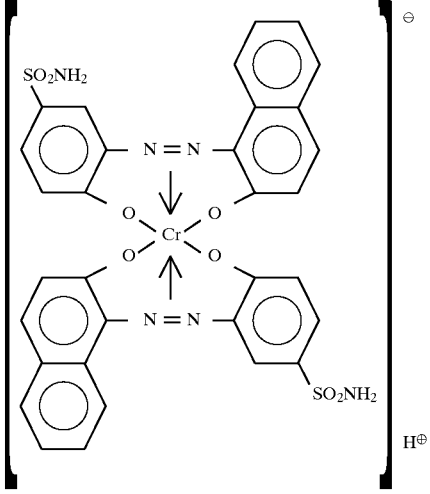
Compound No. (9)

-continued
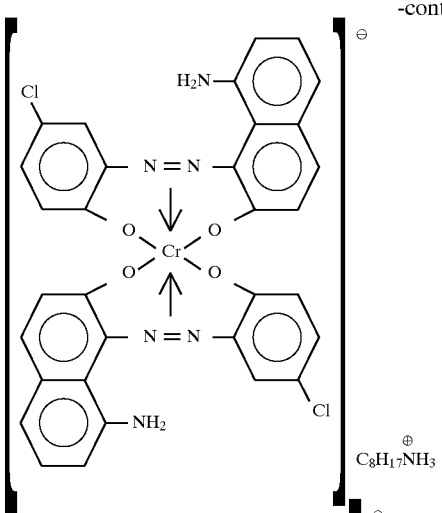
Compound No. (10)
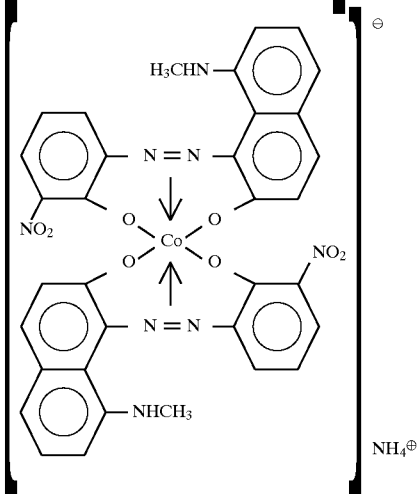
Compound No. (11)
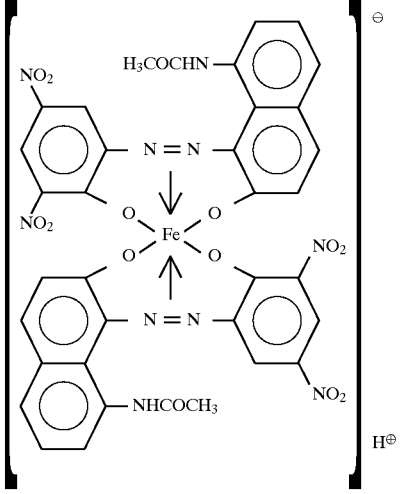
Compound No. (12)

-continued
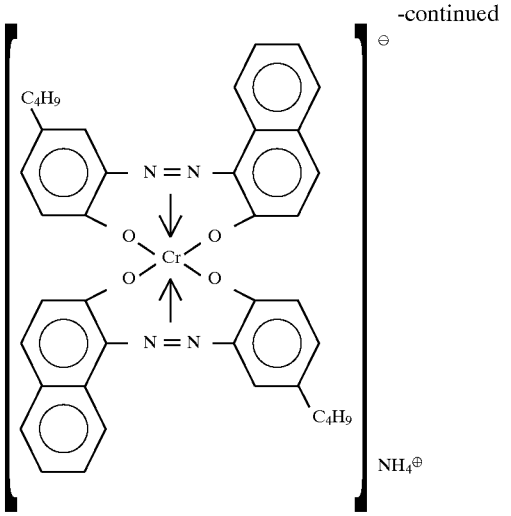
Compound No. (13)
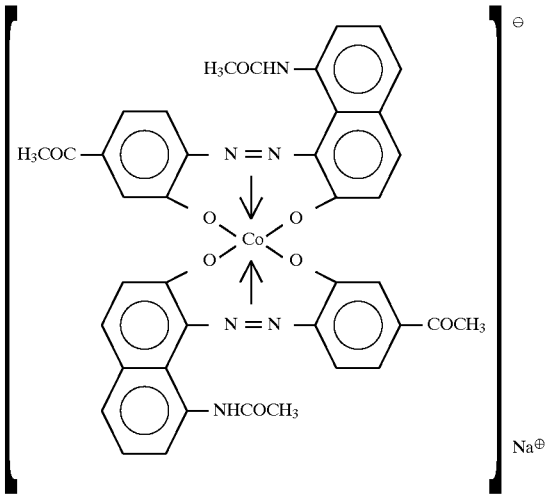
Compound No. (14)
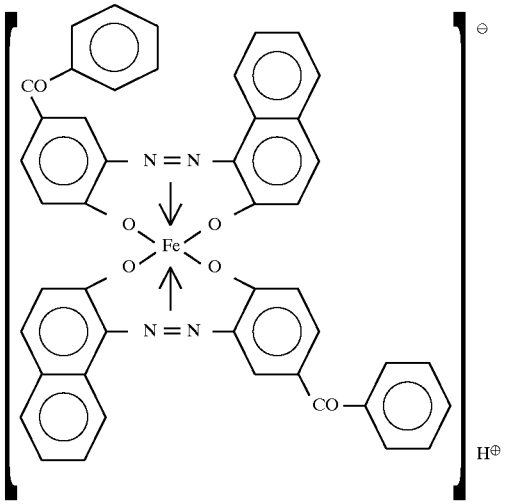
Compound No. (15)

-continued
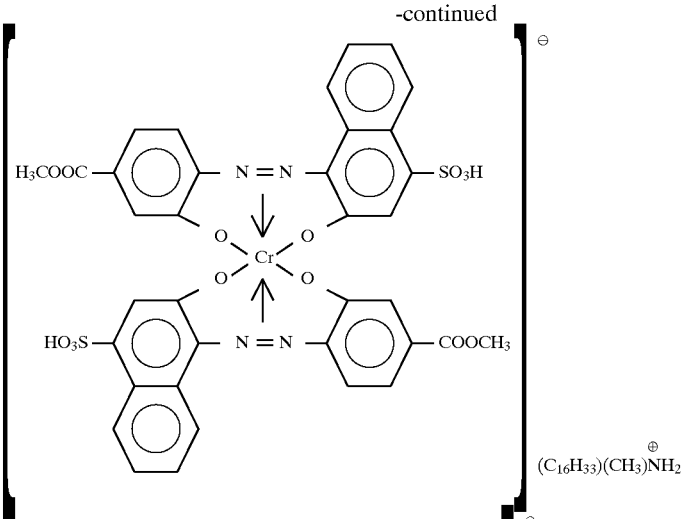
Compound No. (16)
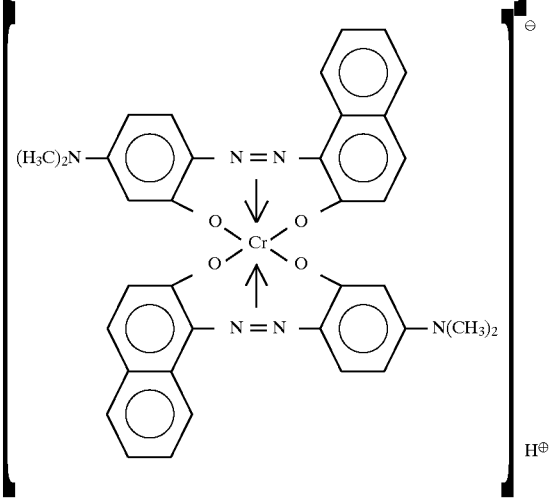
Compound No. (17)
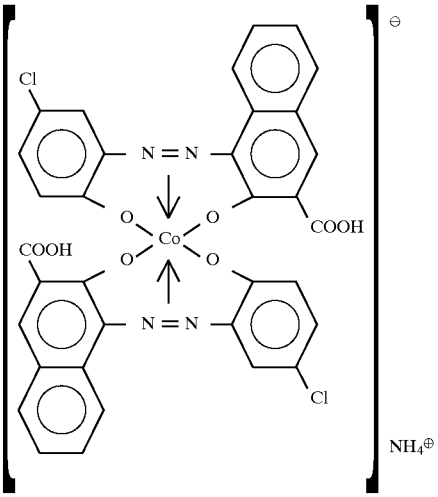
Compound No. (18)

-continued
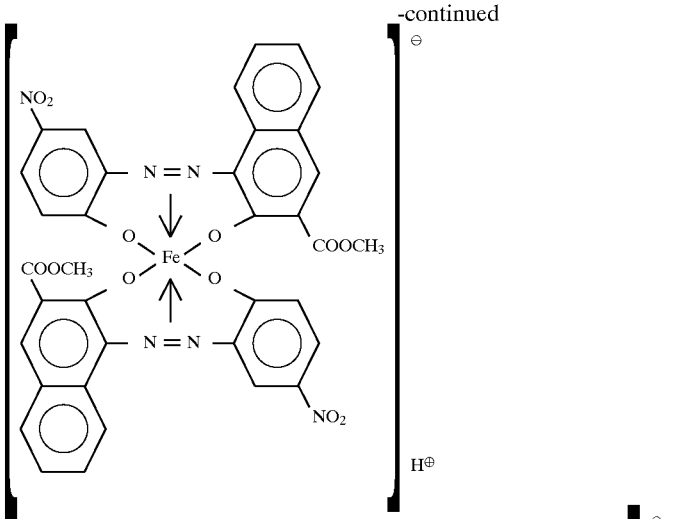
Compound No. (19)
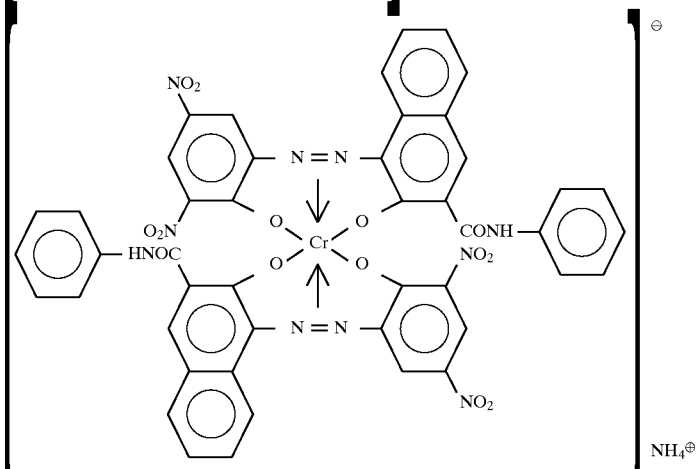
Compound No. (20)
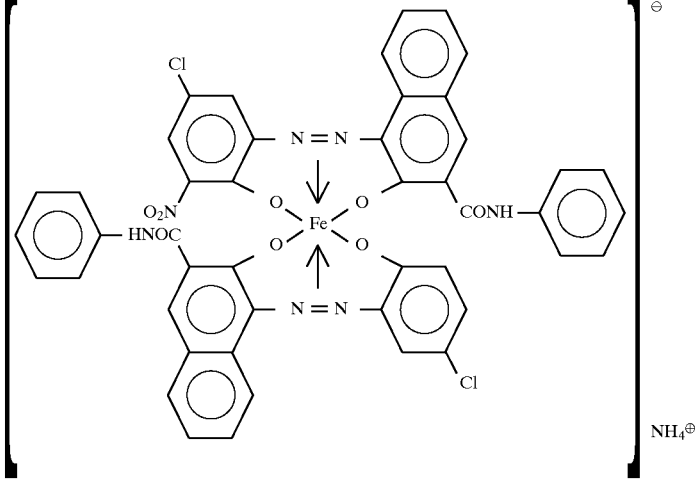
Compound No. (21)

-continued
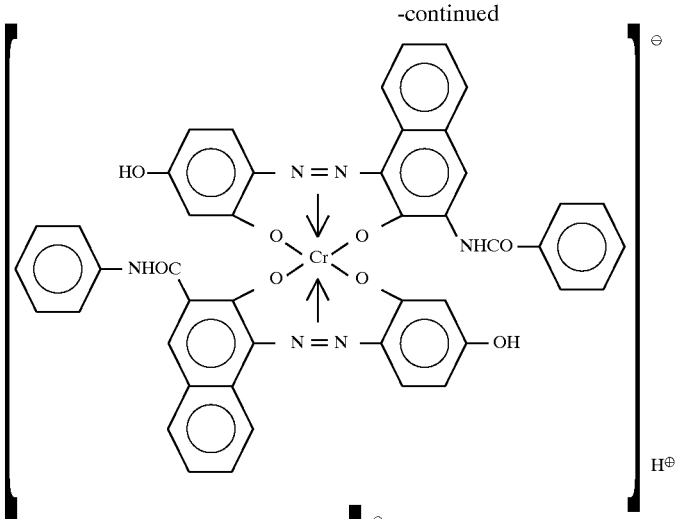
Compound No. (22)
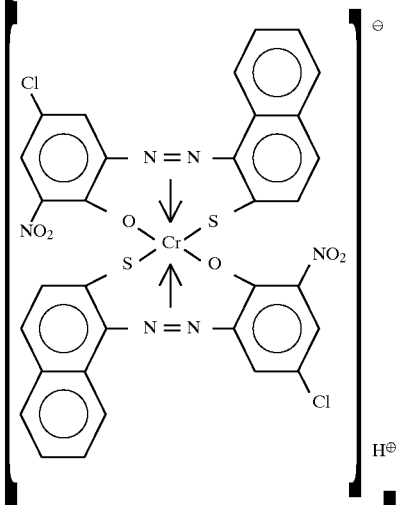
Compound No. (23)
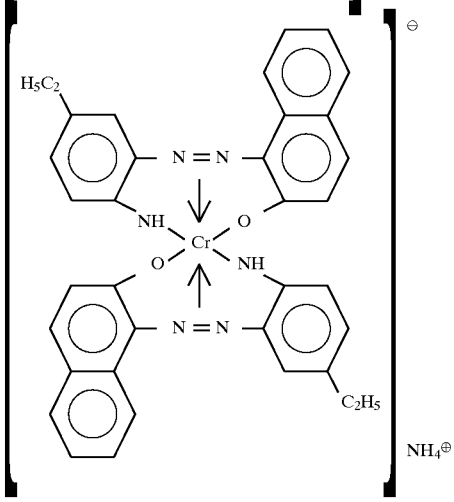
Compound No. (24)

-continued
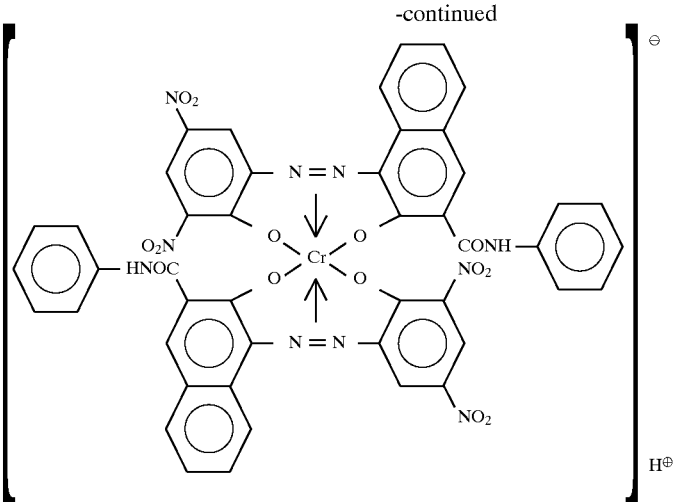
Compound No. (25)
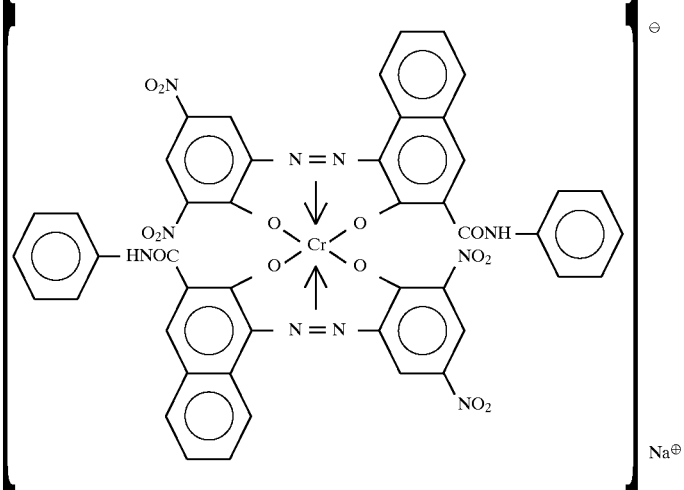
Compound No. (26)
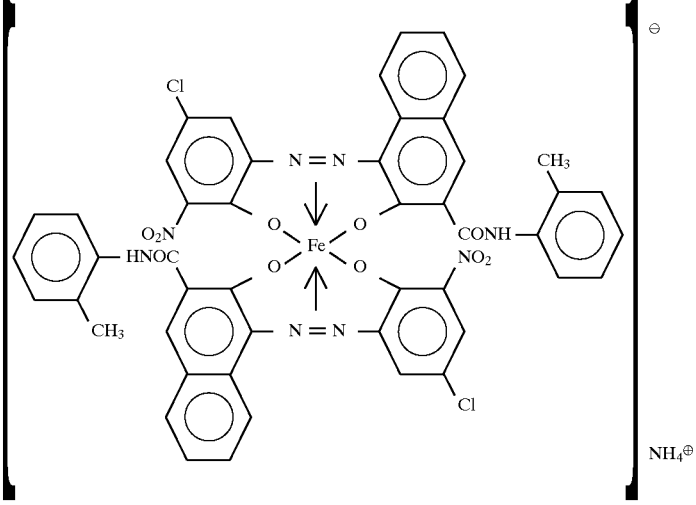
Compound No. (27)

-continued
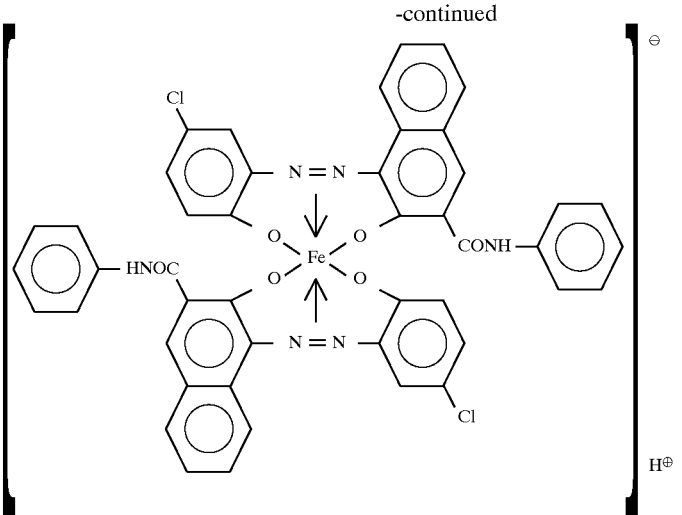
Compound No. (28)
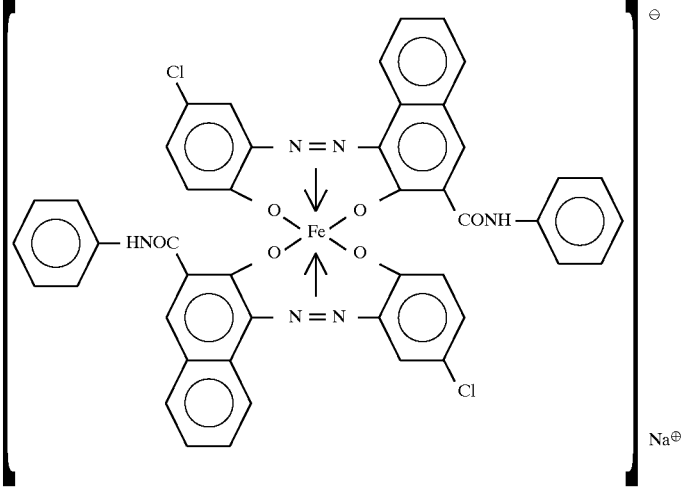
Compound No. (29)
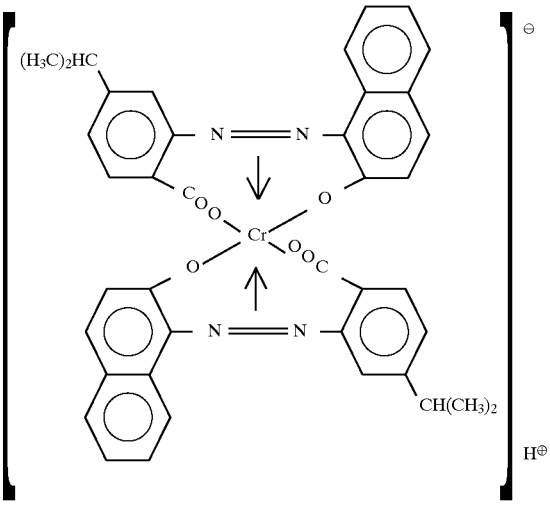
Compound No. (30)

-continued

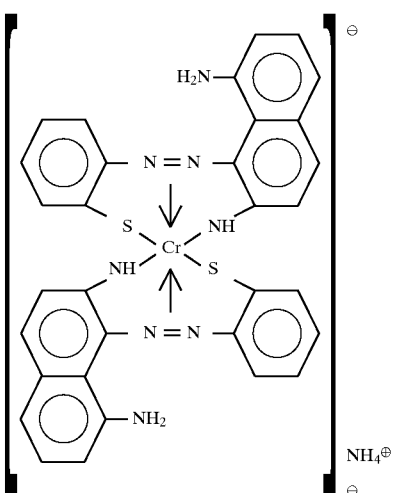

Compound No. (31)

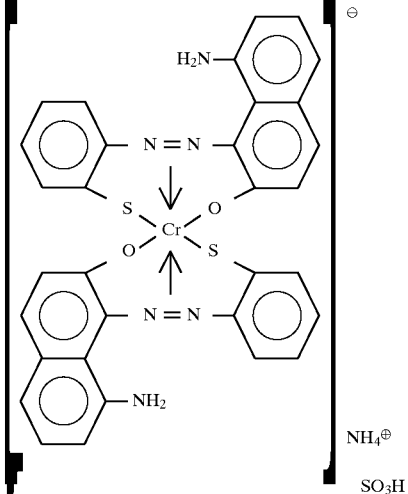

Compound No. (32)

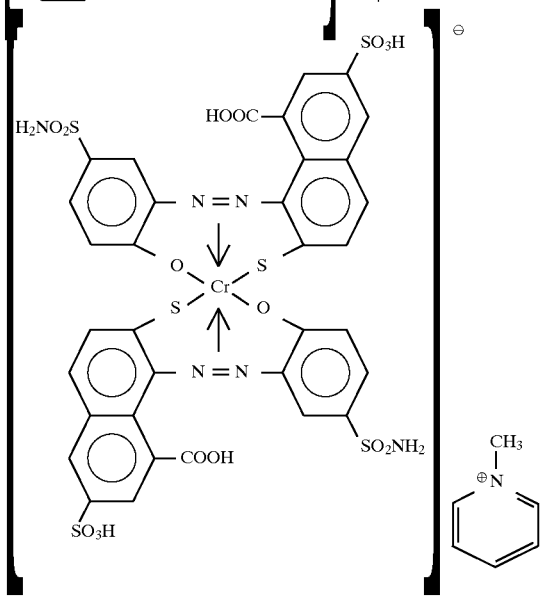

Compound No. (33)

The present invention will be further described in the following examples, but the present invention should not be construed as being limited thereto. The term "parts" as used herein means "parts by weight".

EXAMPLE 1

25 parts of Compound No. (8) and 50 parts of a silicone resin were dissolved in 1,000 parts of a 1:1 (by weight) mixture of toluene and acetone. 50 parts of the resulting solution was coated on 3,000 parts of a spherical ferrite carrier (average grain diameter: 100 $\mu$m) by means of a fluidized bed coating machine.

On the other hand, to 90 parts of styrene-2-ethylhexyl methacrylate were added 5 parts of a polypropylene and 5 parts of carbon black. The mixture was kneaded in a heat-mixer, cooled, coarse-ground, finely ground, and then classified to obtain a black toner having a grain diameter of 10 to 12 μm.

To 97 parts of the above mentioned carrier were added 3 parts of the toner thus obtained. The mixture was then stirred in a ball mill to obtain a developer. The toner was measured for charge by means of a blow-off powder charge meter. The result was 22 μc/g. With this developer charged in a remodelled commercial duplicating machine, an image was duplicated. As a result, a sharp image was obtained at the initial stage as well as after duplicating 10,000 sheets.

EXAMPLE 2

25 parts of Compound No. (7) and 50 parts of styrene-nbutyl methacrylate were dispersed in 1,000 parts of a 1:1 (by weight) mixture of toluene and acetone. 50 parts of the resulting dispersion was coated on 3,000 parts of a spherical ferrite carrier (average grain diameter: 100 μm) by means of a fluidized bed coating machine.

To 97 parts of the carrier thus obtained were added 3 parts of the same toner as used in Example 1. The mixture was then stirred in a ball mill to obtain a developer. The toner was measured for charge by means of a blow-off powder charge meter. The result was 19 μc/g. With this developer charged in a remodelled commercial duplicating machine, an image was duplicated. As a result, a sharp image was obtained at the initial stage as well as after duplicating 10,000 sheets.

EXAMPLE 3

A developer was prepared in the same manner as in Example 1 except that Spilon Blue 2BNH (manufactured from Hodogaya Chemical Co., Ltd.) as a copper phthalocyanine oil soluble dye was used instead of carbon black. The toner was measured for charge by means of a blow-off powder charge meter. The result was 24 μc/g. With this toner charged in a remodelled commercial duplicating machine, an image was duplicated. As a result, a sharp image could be obtained at the initial stage as well as after duplicating 10,000 sheets.

EXAMPLE 4

25 parts of Compound No. (18) and 50 parts of a silicone resin were dissolved in 1,000 parts of a 1:1 (by weight) mixture of toluene and acetone. 50 parts of the resulting solution was coated on 3,000 parts of a spherical ferrite carrier (average grain diameter: 100 μm) by means of a fluidized bed coating machine.

On the other hand, to 89 parts of a low acid value type polyester resin were added 5 parts of a polypropylene and 6 parts of C. I. pigment red 57. The mixture was kneaded in a heat-mixer, cooled, coarse-ground, finely ground, and then classified to obtain a red toner having a grain diameter of 10 to 12 μm.

To 97 parts of the above mentioned carrier were added 3 parts of the toner thus obtained. The mixture was then stirred in a ball mill to obtain a developer. The toner was measured for charge by means of a blow-off powder charge meter. The result was 24 μc/g. With this developer charged in a remodelled commercial duplicating machine, an image was duplicated. As a result, a sharp image was obtained at the initial stage as well as after duplicating 10,000 sheets.

EXAMPLES 5 TO 15

The developers were prepared in the same manner as in Example 1 except that the components shown in Table 1 below is used instead of Compound No. (8) used upon preparation of the carrier. The obtained developers were evaluated in the same as in Example 1.

The results are shown in Table 1 below.

As is apparent from the results of Table 1, the developer using the compounds of the present invention can an excellently sharp image.

TABLE 1

| | | Charge | Image Quality | |
|---|---|---|---|---|
| Example | Compound | Amount of Toner (μc/g) | Initial Stage | After duplicating 10,000 sheets |
| 5 | Compound No. (4) | 21 | Sharp | Sharp |
| 6 | Compound No. (9) | 18 | " | " |
| 7 | Compound No. (11) | 21 | " | " |
| 8 | Compound No. (12) | 22 | " | " |
| 9 | Compound No. (13) | 19 | " | " |
| 10 | Compound No. (16) | 17 | " | " |
| 11 | Compound No. (17) | 19 | " | " |
| 12 | Compound No. (24) | 22 | " | " |
| 13 | Compound No. (25) | 23 | " | " |
| 14 | Compound No. (29) | 21 | " | " |
| 15 | Compound No. (32) | 20 | " | " |

EXAMPLE 16

25 parts of Compound No. (21) and 75 parts of a styrene-methyl methacrylate resin were dissolved in 1,000 parts of a 1:1(by weight) mixture of toluene and acetone. The solution was brush-coated on a toner conveyor member 1 shown in FIG. 1. The coated amount of Compound No. (21) was 4 mg/m$^2$. The toner conveyor member 1 thus treated was then mounted on the development zone.

On the other hand, to 90 parts of styrene-2-ethylhexyl methacrylate were added 5 parts of a polypropylene and 5 parts of carbon black. The mixture was kneaded in a heat-mixer, cooled, coarse-ground, finely ground, and then classified to obtain a black toner having a grain diameter of 10 to 12 μm. 100 parts of the toner were mixed with 0.2 parts of a hydrophobic colloidal silica with stirring in a Henschel mixer to obtain a toner.

With this toner charged in the development zone shown in FIG. 1, an image was duplicated. As a result, a sharp image was obtained at the initial stage as well as after duplicating 10,000 sheets. The toner was measured for charge. The result was 21 μc/g.

EXAMPLE 17

25 parts of Compound No. (35) and 50 parts of a silicone resin were dissolved in 1,000 parts of a 1:1 mixture (by weight) of toluene and acetone. The solution was spray-coated on the toner conveyor member 1 shown in FIG. 1. The coated amount of Compound No. (35) was 4 mg/m$^2$. The toner conveyor member 1 thus treated was then mounted on the development zone.

With the same toner as prepared in Example 11 charged in the development zone shown in FIG. 1, an image was duplicated. As a result, a sharp image was obtained at the initial stage as well as after duplicating 10,000 sheets. The toner was measured for charge. The result was 19 μc/g.

EXAMPLE 18

25 parts of Compound No. (26) and 75 parts of a styrene-methyl methacrylate resin were dissolved in 1,000 parts of a 1:1 mixture (by weight) of toluene and acetone.

The solution was then spray-coated on an elastic blade 2 (made of stainless steel) shown in FIG. 1. The coated amount of Compound No. (26) was 4 mg/m . The elastic blade 2 thus treated was then mounted on the development zone.

On the other hand, to 90 parts of a low acid value type polyester resin were added 5 parts of a polypropylene and 5 parts of Spilon Blue 2BNH as a copper phthalocyanine oilsoluble dye. The mixture was kneaded in a heat-mixer, cooled, coarse-ground, finely ground, and then classified to obtain a blue toner having a grain diameter of 10 to 12 $\mu$m. 100 parts of the toner were mixed with 0.2 parts of a hydrophobic colloidal silica with stirring in a Henschel mixer to obtain a toner.

With this toner charged in the development zone shown in FIG. 1, an image was duplicated. As a result, a sharp image was obtained at the initial stage as well as after duplicating 10,000 sheets. The toner was measured for charge. The result was 17 $\mu$c/g.

EXAMPLE 19

25 parts of Compound No. (28) and 50 parts of a silicone resin were dissolved in 1,000 parts of a 1:1 mixture (by weight) of toluene and acetone. The solution was brush-coated on the elastic blade 2 (made of stainless steel) shown in FIG. 1. The coated amount of Compound No. (28) was 10 mg/m$^2$. The elastic blade 2 thus treated was then mounted on the development zone.

With the same toner as prepared in Example 7 charged in the development zone shown in FIG. 1, an image was duplicated. As a result, a sharp image was obtained at the initial stage as well as after duplicating 10,000 sheets. The toner was measured for charge. The result was 24 $\mu$c/g.

EXAMPLE 20

30 parts of Compound No. (8) and 70 parts of a silicone resin were mixed in a heat-mixer, and then molded into a resin blade. The resin blade thus obtained was then mounted on the elastic blade shown in FIG. 1.

With the same toner as prepared in Example 7 charged in the development zone shown in FIG. 1, an image was duplicated. As a result, a sharp image was obtained at the initial stage as well as after duplicating 10,000 sheets. The toner was measured for charge. The result was 17 $\mu$c/g.

As is apparent from the above explanation, the friction charge-providing member according to the present invention can provide an image with the same quality as obtained at the initial stage even after continuous duplicating. The friction charge-providing member according to the present invention causes no change in positive-chargeability and shows little environmental fluctuations, making it possible to obtain a sharp image even after continuous duplicating.

While the invention has been described in detail and with reference to specific embodiments thereof, it will be apparent to one skilled in the art that various changes and modifications can be made therein without departing from the spirit and scope thereof.

What is claimed is:

1. A friction charge-providing member for positively-chargeable toner, comprising a parent material selected from the group consisting of carriers and conveyor members, wherein the parent material has provided at least on the surface thereon a compound represented by formula (I) as a charge-controlling agent:

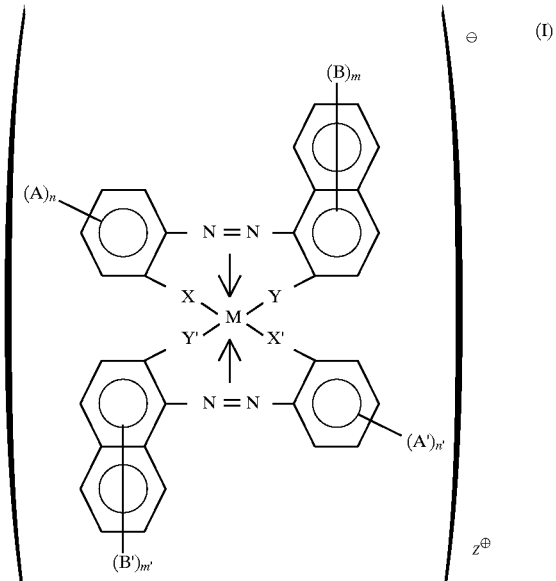

(I)

wherein A and A' are the same or different and each independently represents a hydrogen atom, a halogen atom, a nitro group, an alkyl group having 1 to 18 carbon atoms which may contain a substituent(s), an alkenyl group, an acyl group, a sulfonic acid group, a sulfamoyl group, a N-substituted sulfamoyl group, an alkylsulfonyl group having 1 to 5 carbon atoms, a carboxyl group, an alkylester group having 1 to 5 carbon atoms, a hydroxyl group, an alkoxyl group having 1 to 18 carbon atoms, an amino group, or a N-substituted amino group; B and B' may be the same or different and each independently represents a hydrogen atom, a halogen atom, an alkyl group having 1 to 18 carbon atoms which may contain a substituent(s), an alkenyl group, an amino group, a N-substituted amino group, an acyl group, a benzoylamino group which may contain a substituent(s), a sulfamoyl group, an alkylester group having 1 to 5 carbon atoms, a hydroxyl group, an alkoxyl group having 1 to 18 carbon atoms or a N-substituted carbamoyl group; X, X', Y and Y' are the same or different and each independently represents —O—, —COO—, —NH— or —S— and is present at ortho-position of an azo group; n, n', m and m' are the same or different and each independently represents an integer of 1 to 4; Z represents a hydrogen atom, sodium, potassium, ammonium, aliphatic ammonium, alicyclic ammonium or heterocyclic ammonium; M represents iron.

* * * * *

UNITED STATES PATENT AND TRADEMARK OFFICE

CERTIFICATE OF CORRECTION

PATENT NO. : 5,770,341

DATED : June 23, 1998

INVENTOR(S) : Osamu MUKUDAI, et al.

It is certified that error appears in the above-identified patent and that said Letters Patent is hereby corrected as shown below:

On the title page, Item [73], the Assignee, has been omitted. It should read:

-- Hodogaya Chemical Co., Ltd., Tokyo, JAPAN --
Attorney, Agent or Firm
Oblon, Spivak, McClelland, Maier & Neustadt, P.C.

Signed and Sealed this

Thirtieth Day of March, 1999

*Attest:*

Q. TODD DICKINSON

*Attesting Officer*

*Acting Commissioner of Patents and Trademarks*